US008683726B1

(12) United States Patent
Genton

(10) Patent No.: US 8,683,726 B1
(45) Date of Patent: Apr. 1, 2014

(54) BULLPUP RIFLE FIRE CONTROL SYSTEM

(75) Inventor: Arthur Genton, Hawthorne, FL (US)

(73) Assignee: Good Time Outdoors, Inc., Ocala, FL (US)

( * ) Notice: Subject to any disclaimer, the term of this patent is extended or adjusted under 35 U.S.C. 154(b) by 85 days.

(21) Appl. No.: 13/345,847

(22) Filed: Jan. 9, 2012

(51) Int. Cl.
*F41A 17/56* (2006.01)

(52) U.S. Cl.
USPC ..... 42/17; 42/70.05

(58) Field of Classification Search
None
See application file for complete search history.

(56) References Cited

U.S. PATENT DOCUMENTS

| | | | | |
|---|---|---|---|---|
| 4,395,839 | A * | 8/1983 | Eder | 42/70.08 |
| 4,932,148 | A * | 6/1990 | Barrett | 42/18 |
| 5,216,191 | A * | 6/1993 | Fox | 42/70.05 |
| 5,834,678 | A | 11/1998 | Kalb | |
| 7,225,574 | B2 | 6/2007 | Crandall et al. | |
| 2006/0048425 | A1 | 3/2006 | Frickey | |

* cited by examiner

*Primary Examiner* — Daniel J Troy
*Assistant Examiner* — Benjamin Gomberg
(74) *Attorney, Agent, or Firm* — Sven W. Hanson

(57) ABSTRACT

A novel fire control system for a bolt action firearm includes a firing pin sear located and controlled at one side of the forward end of the bolt. The sear configuration is optimum for rifles having a bullpup form. The location of the sear also provides clearance under the bolt for the bolt to be moved over a firearm magazine without interference with cartridges in the magazine.

11 Claims, 4 Drawing Sheets

BULLPUP RIFLE FIRE CONTROL SYSTEM

BACKGROUND OF THE INVENTION

The present invention pertains to firearm designs, and particularly bolt action assemblies and related firing control systems for manual bolt action firearms.

A "bolt action" is a type of firearm system and action in which the firearm's bolt is operated manually to open and close the breech end of the barrel. The bolt is typically operated with a small handle, most commonly placed on the right-hand side of the firearm. As the handle is operated, the bolt is rotated and unlocked, the breech is opened, and a spent shell casing may be withdrawn and ejected. Typically, the firing pin is then cocked (this may alternatively happen on closing of the bolt, depending on design), and finally a new round/shell/cartridge may be introduced into the breech and the bolt closed. Bolt action firearms are most often "long" barrel rifles, but there are some bolt-action shotguns and a few handguns as well.

In most conventional bolt action firearms, a firing pin is located within the bolt and its sudden forward projection through a front face of the bolt (while engaged with a cartridge) fires a cartridge. Many different fire control systems and devices have been developed to control the release or activation of the firing pin. Due to the necessary relative placements of the bolt, magazine and trigger, the fire control system typically engages and controls the firing pin at a point near the rear of both the bolt and the firing pin. In firearms having magazines for introducing multiple consecutive cartridges into the breech, the position of the magazine—behind the barrel opening and forward of the trigger—makes it most convenient and practical to engage the firing pin at a point behind the magazine.

For various reasons including the desire for a shorter overall configuration, the "bullpup" firearm configuration has been developed. In the bullpup configuration, the firearm action, and the breech and magazine, is located behind the trigger. In a bolt action bullpup configuration firearm, the fire control system is complicated by the spatial separation of the trigger from the bolt, and the intervening magazine and cartridge path. This geometry has prevented development of well controlled fire control mechanisms in the past. What is desired is a fire control system that provides fine controlled firing operation in a bullpup design.

SUMMARY OF THE INVENTION

The invention provides a fire control system in which a trigger located forward of a firearm's bolt controls the operation of a firing pin by engaging the firing pin at a location at the forward end of the bolt. A sear extends from the firing pin to engage the firearm barrel when the bolt is locked to the barrel. The sear is located at one side of the bolt. Forward movement of the sear, to allow the firing pin to fire a cartridge, is controlled in one embodiment by a sear stop pin that is located in a passage in the barrel and is in turn controlled by the trigger.

In all embodiments of the invention, the sear extends laterally from the bolt and is separated from the region and space directly below the bolt longitudinal centerline to allow the bolt to be moved forward and backward over a firearm magazine without the sear contacting or otherwise interfering with cartridges in the magazine.

The present invention provides improved action over the prior art by minimizing the spatial separation between the trigger and firing pin in configurations where a magazine is located behind the trigger.

While the invention provides particular advantages in rifles with a bullpup form, the inventive fire control system is applicable to other firearm forms and configurations and is not limited to the particular embodiments illustrated in the below detailed description. Additional novel aspects and benefits of the invention will be discerned from the following description of particular embodiments and the accompanying figures.

DETAILED DESCRIPTION OF EMBODIMENTS OF THE INVENTION

Figure 1:
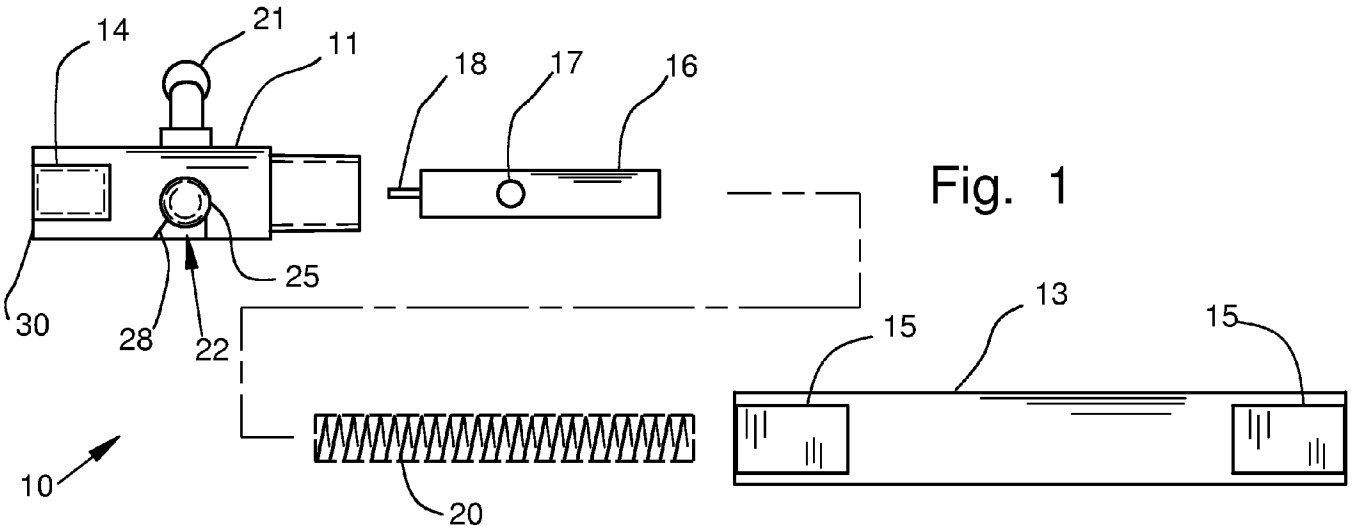
FIG. 1 is side view of exploded bolt assembly according to the invention.

The accompanying illustrations regard a common configuration and reference numbers used in the below discussion may be found on one or more of the illustrations. FIG. 1 is an exploded side view of the components of an assembly of a rifle bolt 10 according to the invention. The bolt 10 includes a bolt body of two mating portions, a forward portion 11 and a rear portion 13. These two portions may be securely joined by respective mating female and male threaded end portions. This particular construction of joined separate portions is for convenience of manufacture and assembly and not critical to the function of the bolt 10. Other, alternative, constructions may be used to accomplish the same result.

Both portions of the bolt 10 are at least partially hollow, each having a longitudinal bore closed at the opposing bolt ends. Within this bore is disposed an elongated cylindrical firing pin 16 and a firing pin spring 20 configured to bias the firing pin 16 toward the forward end of the bolt 10 when the bolt is assembled. The firing pin 16 is configured to move slidably within the bore.

The forward portion 11 has two locking lugs 14 that extend laterally from the outer surface of the bolt 10. The lugs 14 are preferably located diametrically opposing each other on the bolt forward portion 11. Alternatively, more than two lugs may be used to accomplish the same function, but two are preferred for simplicity. The function and operation of the lugs 14 are described in detail below.

The bolt rear portion 13 includes two sets of guide lugs 15. Each set includes two guide lugs 15 extending outward from the outer surface of the bolt rear portion 13. The two sets of guide lugs 15 are spaced apart longitudinally on the rear portion. The particular location and orientation of the guide lugs 15 is not critical to the invention and may be modified to accommodate incidental aspects of the firearm or a desired function or operation independent from or related to the inventive aspects. Generally, the guide lugs 15 are sized, located and configured to locationally guide and stabilize the bolt 10 relative to the rifle during operation.

The firing pin 16 has a transverse sear bore 17. The bolt 10 has a lateral aperture 22 that allows a sear pin 24 (see FIG. 2*b*) to extend from outside the bolt 10 and through the lateral aperture 22 to be received in the sear bore 17. Preferably, for manufacturing and assembly purposes, the sear 24 is received in a sliding fit within the sear bore 17 to allow the sear 24 to move radially and rotate within the firing pin sear bore 17. However, alternatively, the sear 24 may be integral to the firing pin 16 or rigidly fixed with the sear bore 17 although such a configuration presents difficulties at least in manufacturing.

Figure 6:
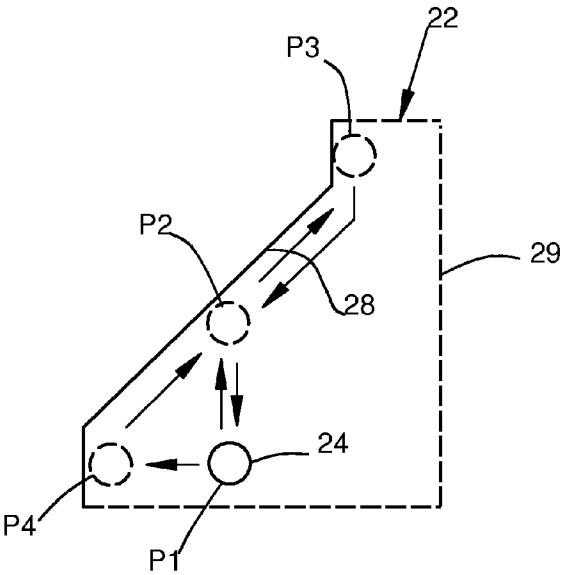
FIG. 6 is a planar projection of the bolt sear control surface.
Figure 5A:
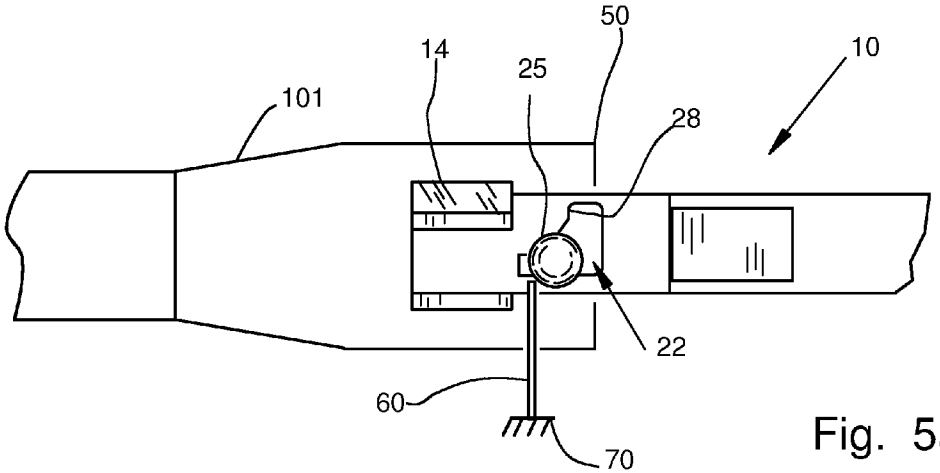
FIGS. 5*a* and 5*b* are detailed side views of the interconnecting elements of the inventive bolt and barrel and elements of the firing function.

The sear pin 24 is preferably formed of a solid rigid elongated cylinder, terminating at an outer end with an enlarged circular head 25. The pin 24 is concentric with its head 25. With the sear pin 24 received in the sear bore 17, the location and travel of the firing pin 16 within the bolt 10 is controlled by the perimeter edge of the lateral aperture 22. The lateral aperture sidewall along at least a portion of this perimeter functions in the invention as a sear pin control surface 28 (FIGS. 5*a*, 6). The details and operational coordination of the control surface 28, sear 24, and the firing pin 16 is described in detail below.

The firing pin 16 includes a firing pin head 18 having a reduced diameter and extending from the forward end of the firing pin 16. The configuration, function and operation of this aspect of the firing pin 16 follow conventional firing pin constructions.

The bolt 10 further includes a bolt handle 21 that extends rigidly generally outwardly from the outer surface of the bolt 10. The bolt handle 21 functions in the manner of conventional manual bolts: to rotate and translate the bolt during rifle operations. The particular configuration of the bolt handle 21 is not critical but is determined by the constraints of the other aspects of the invention and the desires of the user.

As discussed above, in the exemplary configuration illustrated in the figures, the two portions of the bolt are interconnected by mating threaded end portions. This construction allows for relative rotation of the two portions during operation of the bolt and rifle. For example, when the bolt handle 21 is used to rotate and lock or unlock the bolt from the rifle barrel (see FIG. 3*a*) the forward portion 11 rotates relative to the rear portion 13 which is rotationally restrained by the guide surfaces of the firearm frame. As mentioned previously, this relationship and function can be achieved by other mechanisms and constructions. Preferably, the threads have a Class 3 form.

Figure 2B:
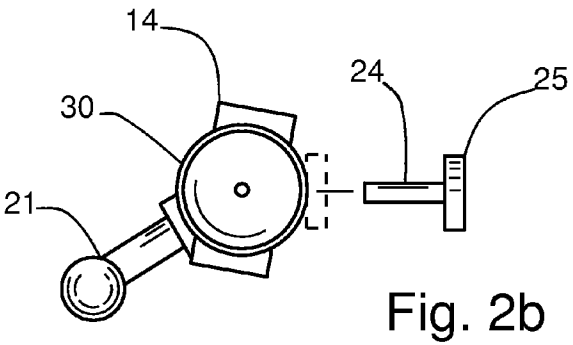
FIGS. 2*a* and 2*b* are end views of configurations of the embodiment of FIG. 1.
Figure 2A:
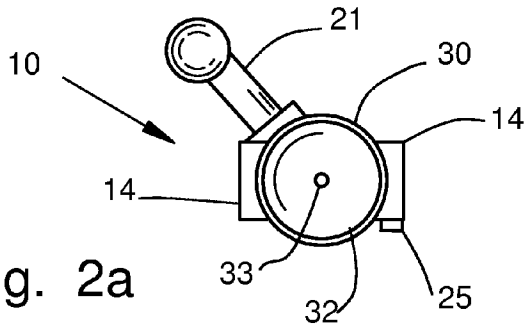

FIGS. 2*a* and 2*b* are end views of the bolt of FIG. 1. The forward end 30 of the bolt 10 is closed by an engagement surface 32 configured to engage, load, and retain, in conventional fashion during loading and firing, the particular cartridges to be fired in the firearm. A firing pin hole 33 is provided to allow the firing pin head 18 (FIG. 1) to extend therethrough to strike a cartridge held against the engagement surface 32 during firing in an operation similar to the conventional operation of other manual rifle bolts having a central firing pin. In FIG. 2*b*, the sear pin 24 is shown, for illustration purposes, withdrawn from the transverse bore in the firing pin and from the bolt 10.

While the configuration illustrated depicts a centerline firing pin head 18, other configurations may be used. The present invention may be used with other, alternative, configurations of firing pin head or other cartridge contact mechanisms that are driven by forward motion of the firing pin to fire the weapon.

Figure 3B:
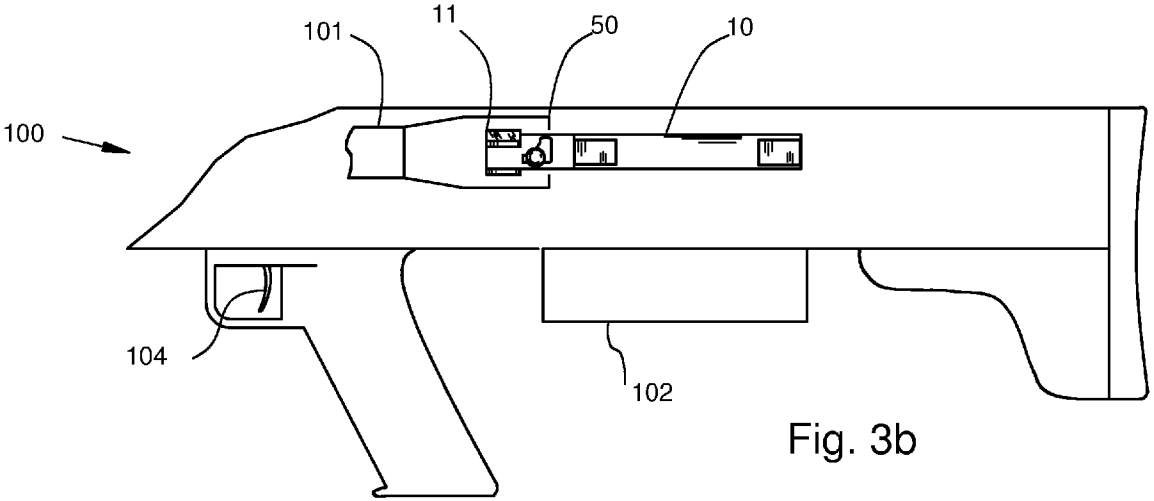
FIGS. 3*a* and 3*b* are side views of a rifle according to the invention.
Figure 3A:
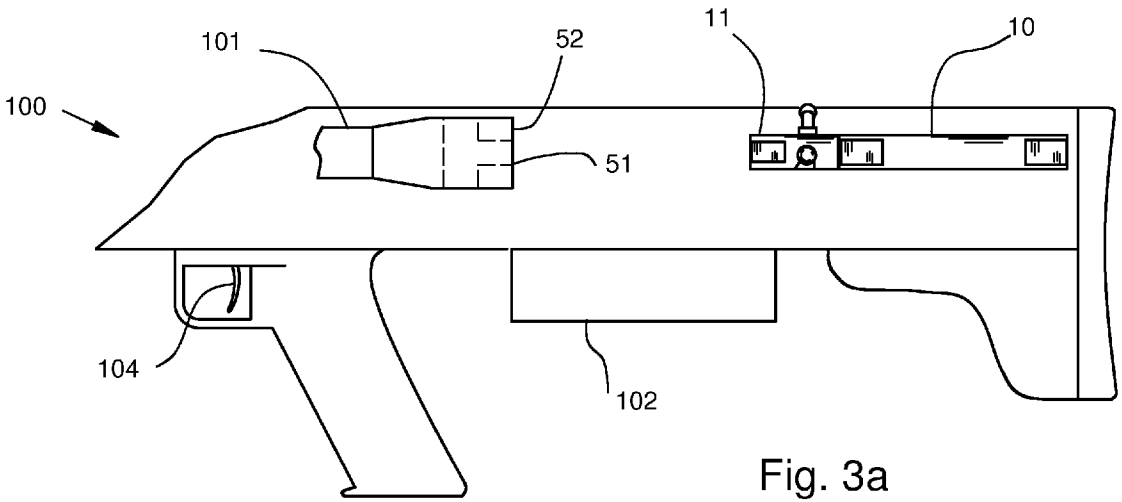

FIGS. 3*a* and 3*b* depict in side views a rifle 100 according to the invention incorporating the bolt 10 of FIG. 1. For convenience of scale, the forward structures of the rifle 100 are not shown. The rifle 100 is depicted in generally transparent outline form to allow showing the location and interaction of the operational elements. Generally, the rifle 100 includes a barrel 101, a magazine 102 for introducing cartridges into the rifle 100, and a trigger 104. The rifle 100 illustrated has a generally bullpup configuration with the trigger 104 located forward of the magazine 102 and breech end 50 of the barrel 101.

The rifle 100 includes the bolt 10 of FIG. 1. In FIG. 3*a*, the bolt 10 is located rearward of the barrel 101 and magazine 102. In this configuration the bolt 10 may be, during operation, moved forward to introduce the bolt to the barrel 101 for locking there. FIG. 2*a* provides an end view of the forward end of the bolt 10 in the configuration shown in FIG. 3*a*. This configuration defines an open condition in which the bolt 10 is separated and/or unlocked from the barrel 101. When cartridges are available in the magazine 102 and biased upward in conventional manner into the rifle 100, forward movement of the bolt 10 from the location in FIG. 3*a*, will engage a cartridge and force it forward ahead of the bolt 10.

Figure 4:
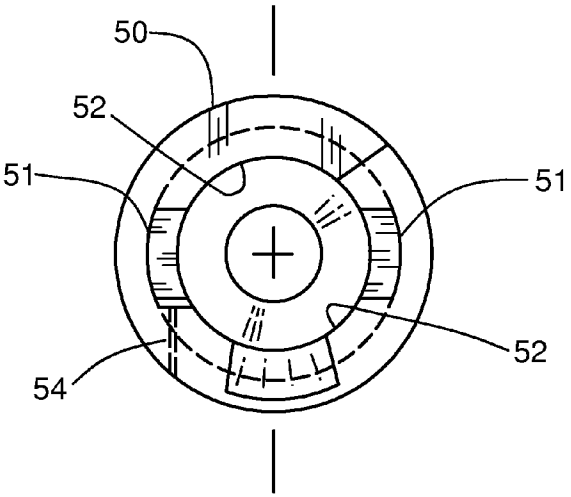
FIG. 4 is a detailed end view of the breech end of a rifle barrel according to the invention.

FIG. 3*b* illustrates the bolt 10 as engaged with and locked into the breech end 50 of the barrel 101. FIG. 4 is an end view of the breech end 50 of the barrel 101 in FIGS. 3*a* and 3*b*. The barrel breech end 50 includes internal longitudinal lug slots 51 configured to receive the bolt forward lugs 14 (FIG. 1) when the bolt 10 is in the open condition. Once fully engaged into the breech end 50 and rotated (clockwise in FIG. 4), the lugs pass in front of internal circumferential lug flanges 52 that prevent rearward movement of the lugs and the bolt 10. The function and details of interaction of the forward lugs 14 and barrel to secure the bolt 10 to the barrel will be obvious to one skilled in the art and construction of these elements consistent with the invention and the intentions defined herein. Variations and alterations of the lug configuration and barrel breech end constructions are contemplated and will be obvious to those skilled in the art. The configuration shown in FIG. 3*b* (and FIG. 2*b*) defines a locked condition in which the bolt 10 is secured to the barrel 101 as necessary for firing of the rifle 100.

FIGS. 2*a*, 2*b*, 3*a*, and 3*b* also depict some of the conditions of operation of the sear 24. In FIGS. 2*a* and 3*a* the sear head 25 is aligned with and behind one of the bolt forward lugs 14—at the left side of the bolt 10. When the bolt 10 enters the breech end 50 the sear head 25 follows the forward lug 14 into a respective lug slot 51. The sear head is configured to closely match the upper and lower surfaces of the lug slot 51. In this manner, the sear 24 is held by the barrel 101 when, in subsequent operation, the bolt 10 is rotated to lock the bolt 10 to the barrel 101. This locking operation will therefore force a relative rotation of the sear 24 in the bolt 10. In so doing, the sear 24 travels across the bolt aperture 22 (FIG. 5*a*).

FIG. 2*b* illustrates the relative rotation of the sear head 25 that has remained in the same orientation (relative to the firearm) as in FIG. 2*a* while the forward lugs 14 have rotated about the bolt (and barrel) longitudinal axis. These figures also depict the location of the handle 21 that is used to manipulate the bolt 10 through the operations just described.

The guiding and supporting structures within the rifle 100 that interact with the bolt 10 in the operations described with respect to FIGS. 3*a*, 3*b* are not shown, but may follow constructions according to the prior art that are compatible with the inventive structures, operation and intent.

FIG. 4 also depicts a vertical sear stop pin bore 54 in the barrel 101 adjacent the breech end 50. The stop pin bore 54 supports and allows a sear stop pin 60 to be introduced into the barrel breech end 50. The stop pin 60 is a rigid elongated cylindrical element. The stop pin bore 54 is sized, located and configured to allow the stop pin 60 to slidably extend through it and into one of the lug slots 51 in a manner to block movement of the sear head 25 forward of the stop pin 60; and to be forced downward by the sear head 25 to allow forward passage of the sear 24 during firing. In this manner, the stop pin 60 acts as part of the control mechanism of sear movement during firing.

Figure 5B:
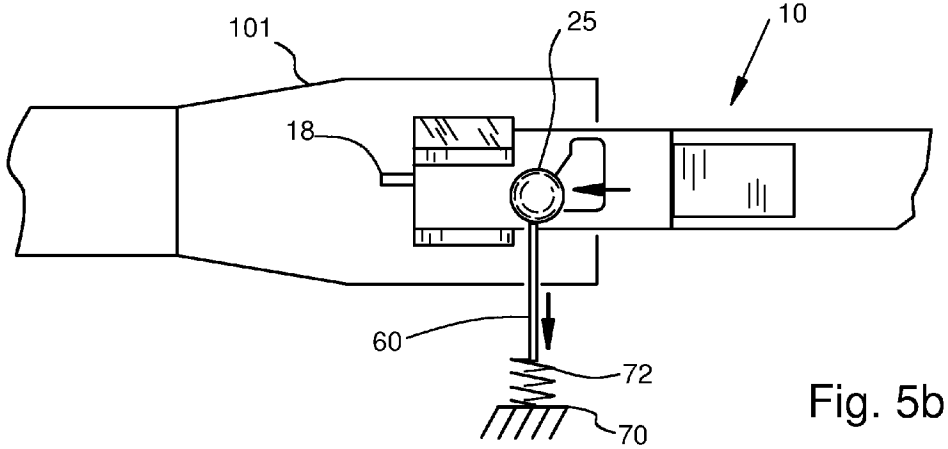

FIGS. 5*a* and 5*b* depict this interaction. FIGS. 5*a* and 5*b* are detailed side views of the barrel 101, adjacent its breech end 50 and the forward portion of the bolt 10. In these figures, the barrel 101 is shown in transparent outline and its details are not shown for clarity. In FIG. 5*a*, the bolt is in the locked condition. In this condition, the sear head 25 has been received into the lug slots (FIG. 4). The bolt 10 has then been rotated to allow the sear 24 (FIG. 2*b*) to traverse partially forward along the control surface 28 until the sear head 25 is blocked by contact with the stop pin 60. The stop pin 60 is rigidly prevented from moving downward by a trigger mechanism 70 that is depicted schematically in these figures.

In FIG. 5*b*, in a firing condition, the trigger mechanism 70 has been operated to allow the stop pin 60 to move downward within the stop pin bore 54 (a motion arrow in the figure depicts the relative movement). Preferably, the stop pin 60 is biased upward by a trigger mechanism spring 72 in this condition. This trigger spring 72 must be configured to be overcome by the force of the firing pin spring (FIG. 1) such that the firing pin 16 and sear 24 are pushed forward (depicted by the horizontal movement arrow in the figure) past the stop pin 60; the sear head 25 is shown displacing the stop pin 60. This forward movement of the sear 24, and with it the firing pin 16, thrusts the firing pin head 18 (FIG. 1) from the bolt 10 to fire a cartridge engaged with the bolt 10 in the breech.

The sear head 25 may slide over the end of the stop pin 60 or may rotate about it's own axis for the same result. To enable this forward movement of the sear 25, pushing the stop pin 60 down while passing, the stop pin 60 must first contact the sear head 25 well below the horizontal centerline of the sear head 25. This will be accomplished satisfactorily if the stop pin 60 extends vertically upward within the lug slot 51 no more than a dimension equal ten percent (10%) of the diameter dimension of the sear head 25. This assumes reasonable spring rates for the trigger spring 72 and the firing pin spring 20 as might be used in conventional mechanisms.

The sear head 25 is round for convenience of manufacture and assembly. However, the function of the sear head 25 allow for other shapes and configurations. The sear head 25 should have sufficient longitudinal dimension such that, after its travel over the stop pin 60, the stop pin is retained low enough to allow rearward motion of the sear head 25. That is, the stop pin 60 should not be allowed to reemerge behind the sear head 25. In alternative configurations, the shape of the sear head 25 contacting the stop pin may be noncircular or contain linear portions. The portions of the sear head 25 that do not contact the stop pin 60 may take other shapes as well. However, noncircular sear heads may preclude rotation of the sear head 25 during the firing action—when the sear head travels over the stop pin 60.

In FIGS. 5*a* and 5*b*, for clarity, the firing pin is not illustrated although it would be visible through the aperture 22 in the bolt 10.

The term "trigger mechanism" is used here to indicate one of any of a variety of systems and mechanisms to accomplish the functions described. It should be clear that the trigger 104 shown in FIGS. 3*a*, 3*b* may be an element of the trigger mechanism 70. The trigger mechanism 70 may take the form of modifications of systems described in the prior art, and their application here will be clear from the intentions and structures of the invention here described. One particular novel element in the invention is that the stop pin 60 is located and operated at a location laterally distanced from the barrel and rifle longitudinal centerline vertical plane (off center), and the trigger mechanism controlling it must provide for that configuration. Unlike most release mechanisms used with spring driven firing pins, the release mechanism here (sear and stop pin) is not located beneath the firing pin, but rather at the side of the firing pin and bolt.

FIG. 6 is a planar projection of a side (lateral) view of the sear control surface 28 of the bolt. The above discussions of the operation and function of the sear will now be further detailed with respect to the control surface 28. As discussed above, the sear 24 is secured to the firing pin 16. The forward and backward movement of the firing pin 16 is controlled by operation of the sear 24, by both the control surface 28 (via rotation of the bolt) and the sear stop pin 60 in the rifle barrel. The various operational events of the firing pin are depicted in FIG. 6.

With the bolt 10 closed (locked into the barrel) and the rifle unfired, the sear 24 is located in the ready position P1. In this position, the sear 24 is distanced rearward from the control surface 28. In this position, the firing pin spring 20 within the bolt 10 is biasing the firing pin 16 and sear 24 forward while the sear stop pin 60 blocks the sear 24 to prevent any corresponding forward movement.

From the ready position P1, to chamber a cartridge into the rifle barrel, or otherwise to open the bolt, the bolt 10 is rotated such as to move the bolt aperture 22 and its control surface 28 relatively downward to engage the sear 24 at a control surface point engagement point P2 (In the figure, the relative movement of the bolt aperture 22 is illustrated as an opposite displacement of the sear represented by the movement paths and referenced position). Further rotation of the bolt (downward movement of the aperture 22) continues to move the control surface 28 against the sear 24 to force the sear 24 backward until the sear 24 reaches the open position P3. The travel paths of the sear between respective positions are shown as a dash line. In this unlocked open position, the bolt 10 may be moved backward to separate from the barrel.

The bolt 10 may then be moved forward again to chamber a cartridge into the barrel breech end. With the bolt 10 in its most forward position in the barrel (lugs 14 within the lug slots 51), but not locked, the sear 24 remains in the open position P3. In this condition, the sear head 25 is received in the lug slot 51 (FIG. 4) that prevents rotation of the sear 24 about the bolt 10 centerline axis. As the bolt 10 is rotated closed to lock it (the aperture moving relatively upward in the figure) the firing pin spring 20 is allowed to force the sear 24 forward to follow the control surface 28 toward the engagement point P2. This motion results in the sear head 25 moving forward in the lug slot 51 until first contacting the sear stop pin 60 at the engagement point P2 and further rotation of the bolt 10 brings the sear 24 back to the ready position P1.

If the trigger mechanism is now operated to allow the sear stop pin 60 to move downward, the firing pin spring's greater force drives the sear head 25 past the sear stop pin 60 to the fired position P4. During this action, the firing pin 16 moves forward to force the pin head 18 out of the bolt 10 aperture to impact any cartridge present in the barrel chamber to fire it.

After firing, the bolt 10 may be rotated open (downward) again such as to engage the control surface 28 against the sear 24 and move the sear 28 on a post-firing path, past the engagement point P2 to the open position P3. From this condition, the bolt 10 may be moved backward to separate it from the barrel.

As the sear 24 travels backward along the control surface 28 from the fired position P4 and past the longitudinal location of the ready position P1, it releases the sear stop pin 60 which is again forced upward into the lug slot 51 by the trigger spring 72.

Closing the bolt, with or without chambering a cartridge, follows the paths and action as described above from the open position P3 to the ready position P1. The particular dimensions of the control surface 28 and the various positions described are dependent on the specific parameters of the various different possible embodiments of the invention. For example, larger caliber rifles may have larger dimensions due to the larger forces inherent in their operation.

In FIG. 6, the dashed portion of the aperture perimeter 29 may take any convenient shape and is not critical to the inventive functions. The angle of the control surface 28 should be selected at least in part for acceptable forces in rotating the bolt.

Due to the movement of the bolt 10 rearward over the magazine 102 (FIG. 3*a*), it is critical that the sear 24 and sear head 25 be located other than directly below the bolt centerline. Neither the lugs, sear head, nor any other rigid structure may protrude downward from the bolt such as to potentially contact cartridges in a loaded magazine. This is a value of the unique sear and triggering mechanism which functions at the side of the bolt. While the embodiment illustrated depicts the sear 24 extending substantially horizontally from the bolt 10, this orientation may accept slight variation while still satisfying the need for clearance below the bolt as just described. However, such an alternation might require difficult changes in the stop pin geometry.

This requirement is a consequence of the trigger location forward of the magazine 102 and the desirability of maintaining close spatial connection between the trigger and sear in any firearm. The unique close proximity of the trigger to the sear in the present invention, in a rifle configuration where the trigger is forward of the magazine, provides a high quality of operation of the rifle.

The elements described above regarding the invention should preferably be formed of metallic materials consistent with conventional past and future methods of design and fabrication of like devices in firearms. The sear stop pin 60 and sear head should be formed preferably of metal having high impact resistance.

Herein, words indicating direction or relative position such as "vertical", "horizontal", "upward", "forward", "left" and "right" and the like are used for convenience to clarify the relative orientations of the elements as depicted in the drawing figures, wherein the rifle is in a normal operational attitude with a horizontal barrel, and are not intended to be limiting of the invention. Likewise, such terms that are used herein in the claims of the invention should also be interpreted as describing and regarding the relative aspects of the features recited and not as limiting the invention.

Herein the term "rifle" is used generally to describe a firearm sharing the relevant features of the device shown. No limitation on other aspects of the device is intended or should be construed by the term. For example, the presence, or lack thereof, of "rifling", or the length of the barrel is not relevant, or limiting of, the invention.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

The invention claimed is:

1. A novel rifle comprising:

a rifle body;

a magazine configured to introduce cartridges vertically into the rifle body from below the rifle body;

a barrel supported by the rifle body and having a breech end and a sear stop bore located adjacent the breech end;

a bolt comprising:

a bolt body having a longitudinal bore and a lateral aperture;

a firing pin slideably disposed within the longitudinal bore and having a transverse sear bore;

a sear configured to be received in the sear bore and extend from the sear bore through the lateral aperture such that the lateral aperture may control relative rotation and longitudinal movement of the firing pin in the bolt;

a sear stop pin slideably received in the sear stop bore and extending into the barrel such as to block forward movement of the sear in a locked condition wherein also the bolt is secured to the breech end of the barrel and the sear is received within the barrel at the breech end; and a trigger mechanism including a finger trigger located forward of the magazine, the trigger mechanism configured to control the movement of the sear stop pin such as to allow the sear to move forward from the locked condition when the finger trigger is operated.

2. A novel rifle comprising:

a rifle body;

a barrel secured to the rifle body;

the barrel having a breech end and a longitudinal slot extending inside the barrel at the breech end, the slot located laterally from a barrel centerline vertical plane;

a rifle bolt having a longitudinal bore and an aperture;

a firing pin slideably disposed within the bolt longitudinal bore;

a sear extending from the firing pin and through the aperture to terminate outside the bolt, the sear configured to be received in the longitudinal slot;

the bolt and barrel further configured for the bolt to be secured to the breech end with the sear received in the longitudinal slot;

a control means for controlling the forward movement of the sear in the slot when the bolt is secured to the barrel.

3. A novel rifle, according to claim 2, and wherein:

the control means comprises:

a stop pin extending through the barrel and into the slot to block the sear in a locked condition; and a trigger mechanism connected to and operating the stop pin to allow it to be displaced by the sear in a firing condition.

4. A novel rifle, according to claim 2, and wherein:

the firing pin has a transverse bore and the sear is disposed within the transverse bore; and the sear further comprises an enlarged circular head.

5. A rifle fire control system comprising:

a rifle bolt having a longitudinal bore, a lateral aperture and an engagement end configured to engage a cartridge during operation;

a firing pin slideably disposed within the longitudinal bore;

a barrel configured to receive and secure the bolt, the barrel having a breech end and a longitudinal slot extending inside the barrel at the breech end;

a sear extending horizontally from the firing pin and through the lateral aperture, the sear received within the longitudinal slot;

a sear stop pin supported by the barrel and blocking forward movement of the sear in a locked condition;

a trigger mechanism configured to control the movement of the sear stop pin such as to allow the sear to move forward from the locked condition when the trigger mechanism is operated in a firing condition; and the bolt and firing pin configured to fire a cartridge engaged with the engagement end when the sear moves forward from the locked condition.

6. A fire control system, according to claim 5, and wherein:

the firing pin has a firing pin head configured to extend from the engagement end in the firing condition.

7. A fire control system, according to claim 5, and wherein:

the sear has an enlarged head configured to be received in the barrel.

8. A fire control system, according to claim 7, and wherein:

the sear head is circular in shape.

9. A fire control system, according to claim 5, and wherein:

the sear is rigidly fixed to the firing pin.

10. A fire control system, according to claim 5, and wherein:

the bolt comprises forward and rear portions, the two portions rotating relatively when the bolt is closed into the barrel;

the forward portion including the lateral aperture.

11. A fire control system, according to claim 5, and wherein:

the barrel has a stop pin bore; and the sear stop pin is supported within the stop pin bore.

* * * * *